US005272349A

United States Patent [19]

Perry, III

[11] Patent Number: 5,272,349

[45] Date of Patent: Dec. 21, 1993

[54] SOURCE HANDLING APPARATUS

[76] Inventor: Hugh L. Perry, III, 7809B Hardy Dr., Austin, Tex. 78757

[21] Appl. No.: 897,234

[22] Filed: Jun. 11, 1992

[51] Int. Cl.[5] ..... G21F 5/02

[52] U.S. Cl. ..... 250/497.1; 250/357.1; 378/52

[58] Field of Search ..... 250/496.1, 497.1, 357.1; 378/52; 414/146; 600/3, 7

[56] References Cited

U.S. PATENT DOCUMENTS 2,708,721 5/1955 Ziffer ..... 378/52

4,785,178 11/1988 Lynch et al. ..... 250/497.1

*Primary Examiner*—Jack I. Berman

*Attorney, Agent, or Firm*—Rosenblatt & Associates

[57] ABSTRACT

A compact design of a shielded housing for transport and insertion of radioactive sources into wells for use in measuring properties of materials in vessels and the like is disclosed in this invention. The apparatus features a perforated belt which is wound on a drum. The sources are temporarily supported within the shielded housing and can be moved into place and mounted to the belt at the desired locations. Safety features are provided to avoid dropping the sources into the well and to temporarily support the belt so that the transport housing can be removed. The invention also provides for adjustment of the mounting height of the source or sources mounted to the belt.

25 Claims, 7 Drawing Sheets

SOURCE HANDLING APPARATUS

FIELD OF THE INVENTION

The field of this invention relates to an apparatus useful in transport and insertion of radioactive sources in suitable enclosures allowing accurate positioning of the sources while minimizing exposure to operators.

BACKGROUND OF THE INVENTION

Many different processes involve storage vessels to contain raw materials, finished products, bi-products, and intermediate products. Many times the storage conditions involve extremes of temperature and pressure. As part of accurate control of the process, it is desirable to know the level in the vessels and other physical properties of the materials stored therein. Many different devices have been developed to detect level and density of materials in storage vessels. One such measuring system involves the use of nuclear sources installed in wells, which are in turn mounted to the storage vessels. The wells represent an elongated space which is not in fluid communication with the contents of the vessel wherein various nuclear sources are mounted. Adjacent these sources, but outside of the vessel, are corresponding detectors which sense signals emitted by the sources. The accurate placement of sources and detectors is critical to obtaining meaningful data regarding parameters such as level in the vessel or/and physical properties of the materials within the vessel. Clearly, handling of the sources must be done very carefully to minimize exposure to the operator during installation and transport. On many occasions, the clearance available next to a well located on a vessel is limited due to obstructions by other equipment or structural members. It is therefore desirable to have a compact design for a transport enclosure for the sources so that the enclosure can be easily placed in position for insertion of the sources.

Typical installations involve the placement of sources at varying depths within the well. In the past, this has been accomplished by connecting a plurality of sources to a cable, winding the cable with the sources around a drum, and enclosing the drum in a housing. Some of the disadvantages of this type of an arrangement are that the cable with sources attached becomes large and bulky when wound around a drum, necessitating the use of larger and larger housings to transport the sources to the location of use, as well as creating difficulties in actual installation due to the size of the housing used. Another problem that springs from the use of sources permanently attached to a cable is that there is no leeway in adjustment of the relative positions of the sources. Those skilled in the art can readily appreciate that when multiple sources are connected to a cable and precise alignment is required between each source and each detector on the outside of the vessel, complications can arise in obtaining overall alignment of multiple sources and detectors. Due to the permanent attachment, no fine-tuning of the relative placement of the sources is possible. A variation of the cable arrangement, previously described, has also been developed. In this arrangement, a plurality of turnbuckles are installed in the cable so that relative positional changes between the various sources connected to the cable can be made. However, the degree of adjustment is limited. The turnbuckles must be of a fairly small size so that they can wind up on the drum for installation and removal of the sources. Again, the necessity of having all of the sources premounted to a cable, even with the use of turnbuckles, still results in a housing having significant bulk. This creates problems when access to the well on a vessel is fairly limited due to the location of other equipment, utilities, or structural obstructions.

To address the requirements for a compact transport housing for sources, the apparatus of the present invention has been developed. The apparatus of the present invention provides for separate storage of the sources and their supporting members from the mechanism of raising and lowering the sources. Additionally, a perforated belt is designed that has sufficient structural rigidity to support the weight of the sources, yet at the same time is sufficiently flexible so that it can be wound around the drum with the sources separately supported. The compact design of the belt and drum allows for a smaller housing to be used because the drum size is dramatically reduced. The apparatus features safety features to prevent loss of the sources in the well and premarked perforations in the belt for accurate placement of the sources. Several details of the invention also provide for easy adjustment of the source locations, as well as a mechanism for removing the source housing and installing a mounting housing to contain the excess belt extending beyond the well in the vessel. Those and another beneficial features of the invention will be described below in detail.

SUMMARY OF THE INVENTION

A compact design of a shielded housing for transport and insertion of radioactive sources into wells for use in measuring properties of materials in vessels and the like is disclosed in this invention. The apparatus features a perforated belt which is wound on a drum. The sources are temporarily supported within the shielded housing and can be moved into place and mounted to the belt at the desired locations. Safety features are provided to avoid dropping the sources into the well and to temporarily support the belt so that the transport housing can be removed. The invention also provides for adjustment of the mounting position of the source or sources mounted to the belt.

DETAILED DESCRIPTION OF THE PREFERRED EMBODIMENT

Figure 1:
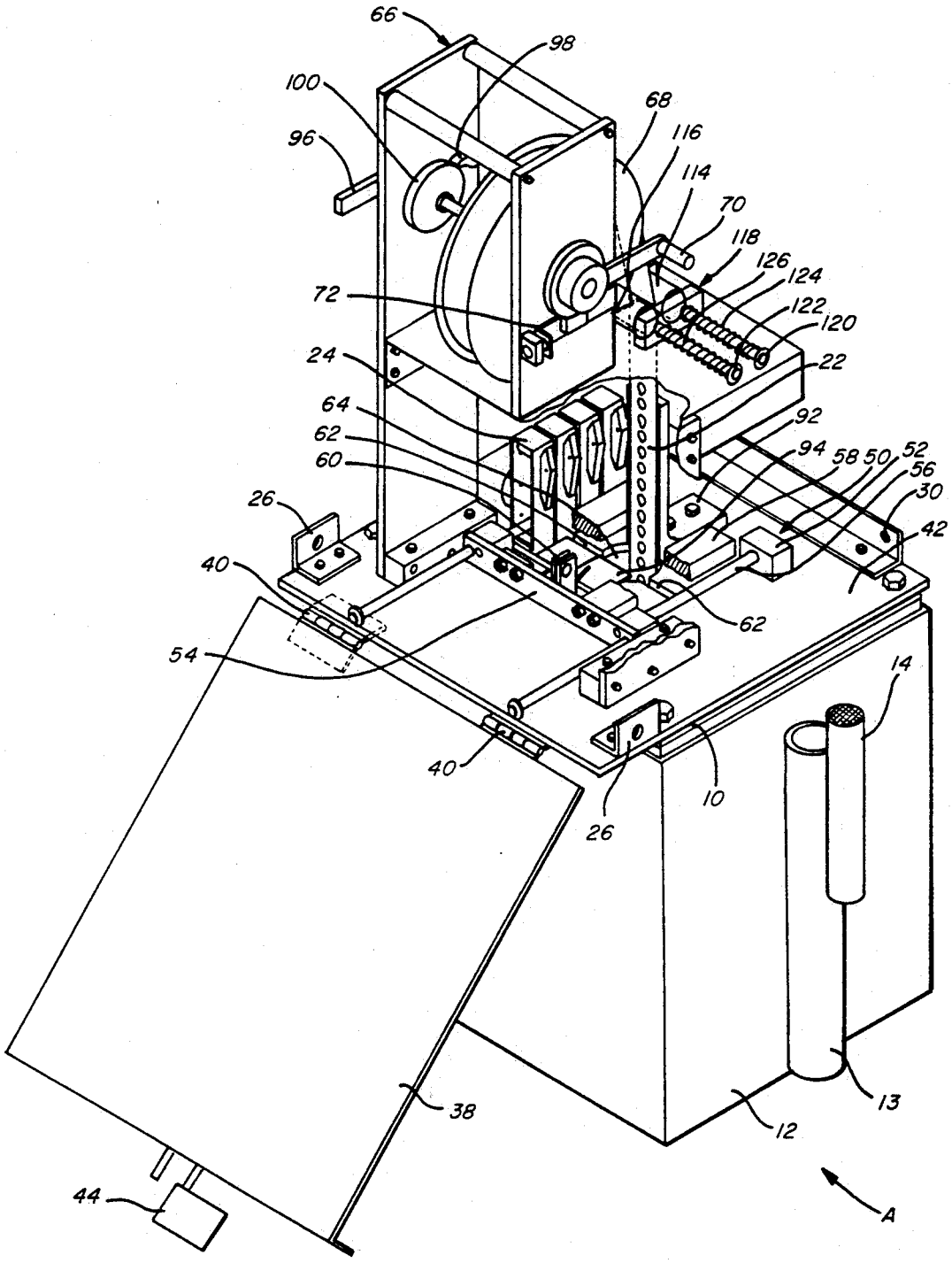
FIG. 1 is a perspective view of the housing showing the placement of the sources and the raising and lowering mechanism.
Figure 2:
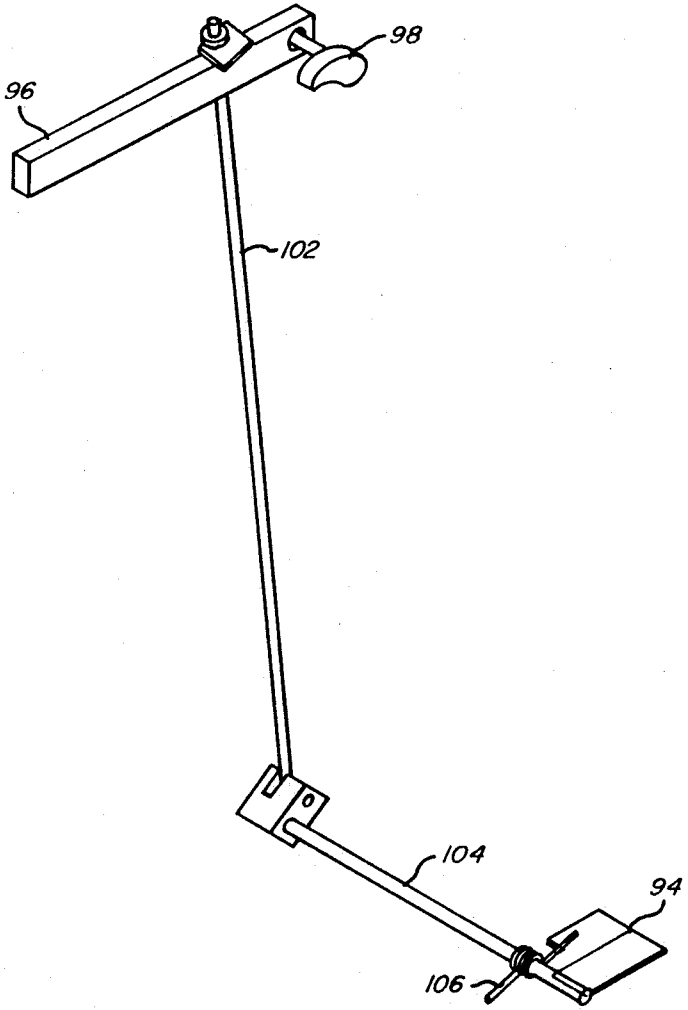
FIG. 2 is a detail of the trap door assembly indicating its interconnection to the drum.
Figure 3:
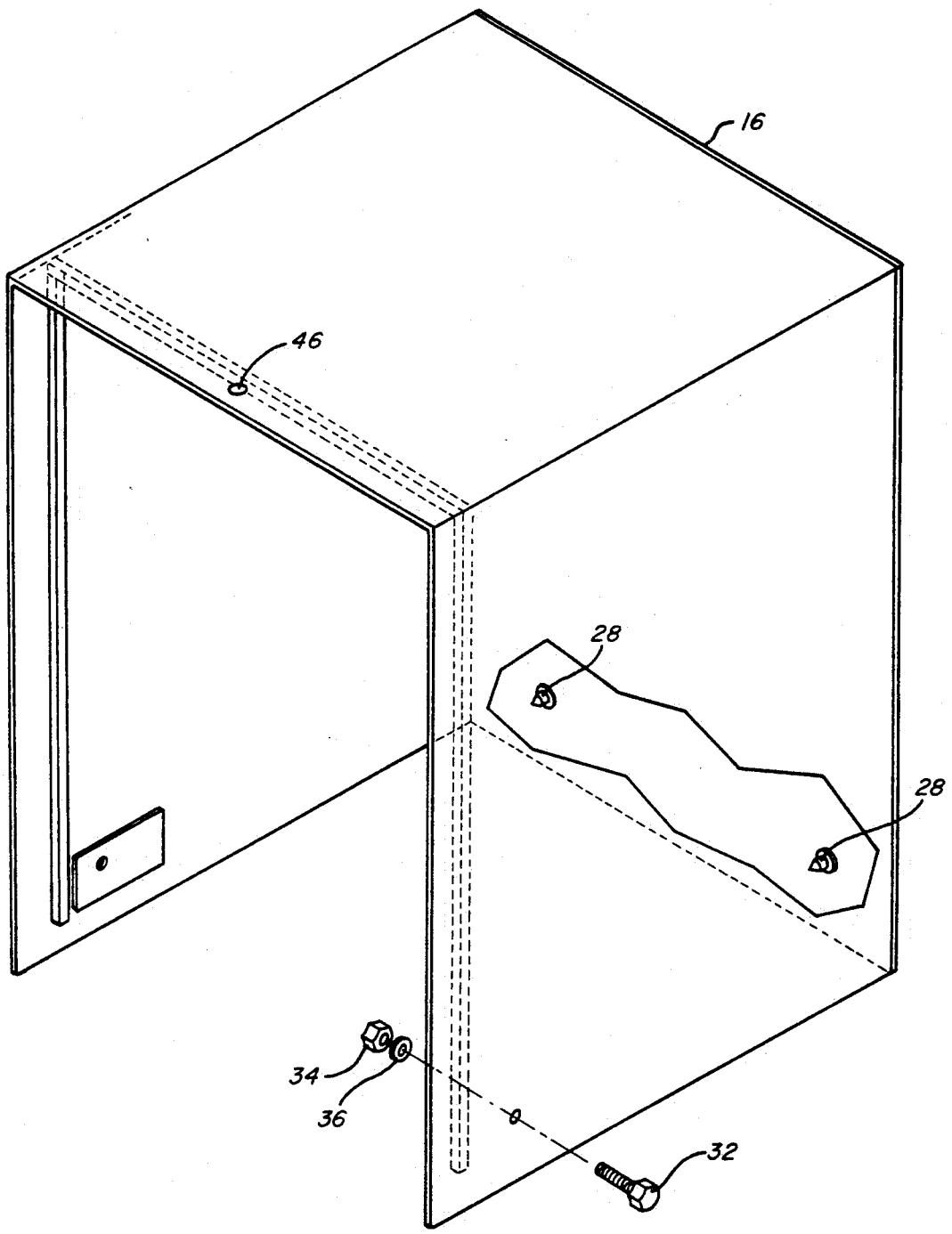
FIG. 3 is the cover for the housing shown in FIG. 1.

The apparatus A of the present invention is shown in FIGS. 1, 2, and 3. The apparatus includes a housing 10 which is covered with a shield 12 preferably lead or another suitable material that can prevent the escape of harmful radiation. The housing 10 is manipulated by lifting on a bail 14 which is shown partially in FIG. 1. In essence, bale 14 is a rod that extends over the top of the housing 10 and is connected to the opposite side of housing 10. Guide tubes 13 engage rods (not shown) to align housing 10 with well 18 for attachment. This allows a hook or similar grasping device to be used to lift the entire housing 10, along with cover 16 shown in FIG. 3 into position above a well 18 (see FIG. 9). Typically, well 18 extends into a vessel or other storage container (not shown) and has an inner space 20 to accommodate belt 22 and the source holder 24 (see FIG. 4).

When shipping the source holders 24 to a particular site for use in a well 18, the housing 10 has cover 16 mounted to brackets 26. A pair of pins 28 extend through openings 30 (see FIG. 1) to secure the rear of cover 16 while bolts 32, coupled with nuts 34 and washers 36 are used to secure the cover 16 to lugs 26. A door 38 is connected by hinges 40 to base 42. Thus, the apparatus A is completely enclosed during shipment due to the securing of cover 16 to base 42, and door 38 being in the closed position and secured to cover 16. A lock 44 can be inserted through opening 46 to secure door 38 in the closed position against cover 16.

Figure 9:
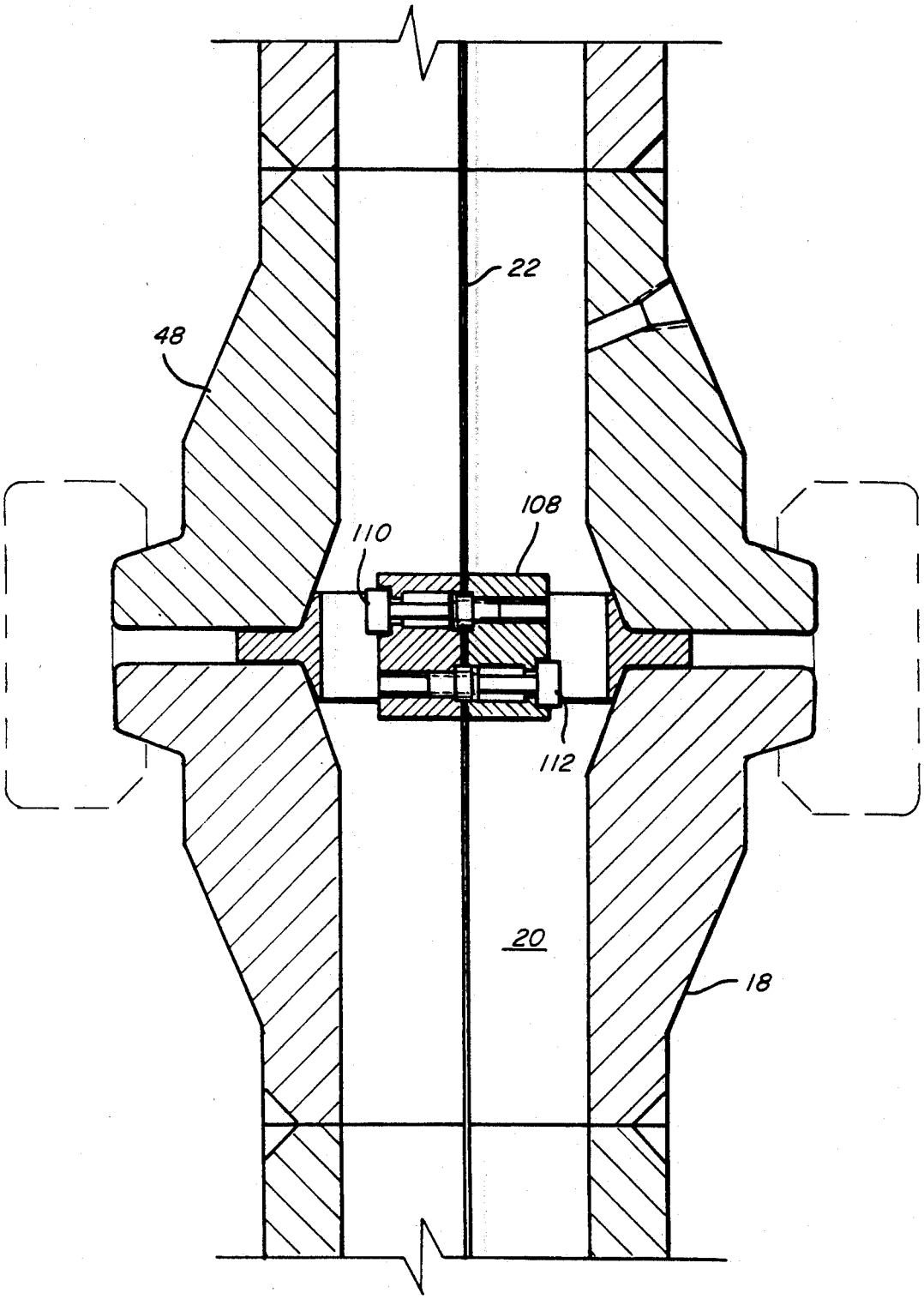
FIG. 9 is a sectional elevational view showing the stop block temporarily suspending the belt in a well after removal of the housing.

Housing 10 has a bottom flange, which is not shown in FIG. 1, but is similar in construction to flange 48 shown in FIG. 9. Thus, the outlet flange 48 connected to housing 10 on its underside is adapted to be directly or indirectly mounted to well 18, which is shown in FIG. 9. The apparatus of the present invention is moved into position by lifting on bail 14 and placing the outlet flange 48 into alignment with the well 18, and securing the two together with a suitable clamp or connector.

At that point, the cover 16 can be removed after opening door 38. When the housing 10 is in the position for shipment, a frame 50, comprising a rear locking bar 52 and a source holder locking bar 54 and locking rods 56 is used to secure the source holders 24 in the position shown in FIG. 1. The frame 50 also includes shields 58, which are typically stainless steel encased lead. The shields 58 are shown cutaway in FIG. 1 to provide further clarity in the drawing, but are in fact continuous members that shift with respect to rods 56 when a lock (not shown) is removed from hasp 60. Removing the lock from the hasp 60 allows source holder locking bar 54 to come forward pulling forward the shields 58 so that slot 62 is exposed. It should be noted that slot 62 extends in opposite directions from well opening 64. Accordingly, with the locking rods 56 in the position shown in FIG. 1, the source holders 24 are locked in the position shown and cannot be moved into slot 62 for mounting to belt 22 lowering into well opening 64. This is because rods 59 extend through the holders of sources 24. In the open position, rods 56 no longer extend through the frames of sources 24, and shields 58 no longer block path 62.

The housing 10 also features a frame 66 which holds a drum 68. Drum 68 is rotated by moving crank 70. Crank 70 can be locked into place by inserting a lock through the drum locking lever or hasp 72.

Figure 8:
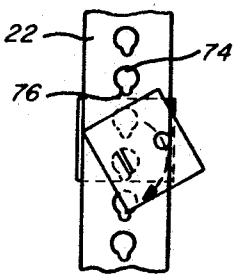
FIG. 8 is an elevational view of a segment of the belt showing how the stop lock position can be adjusted.
Figure 5:
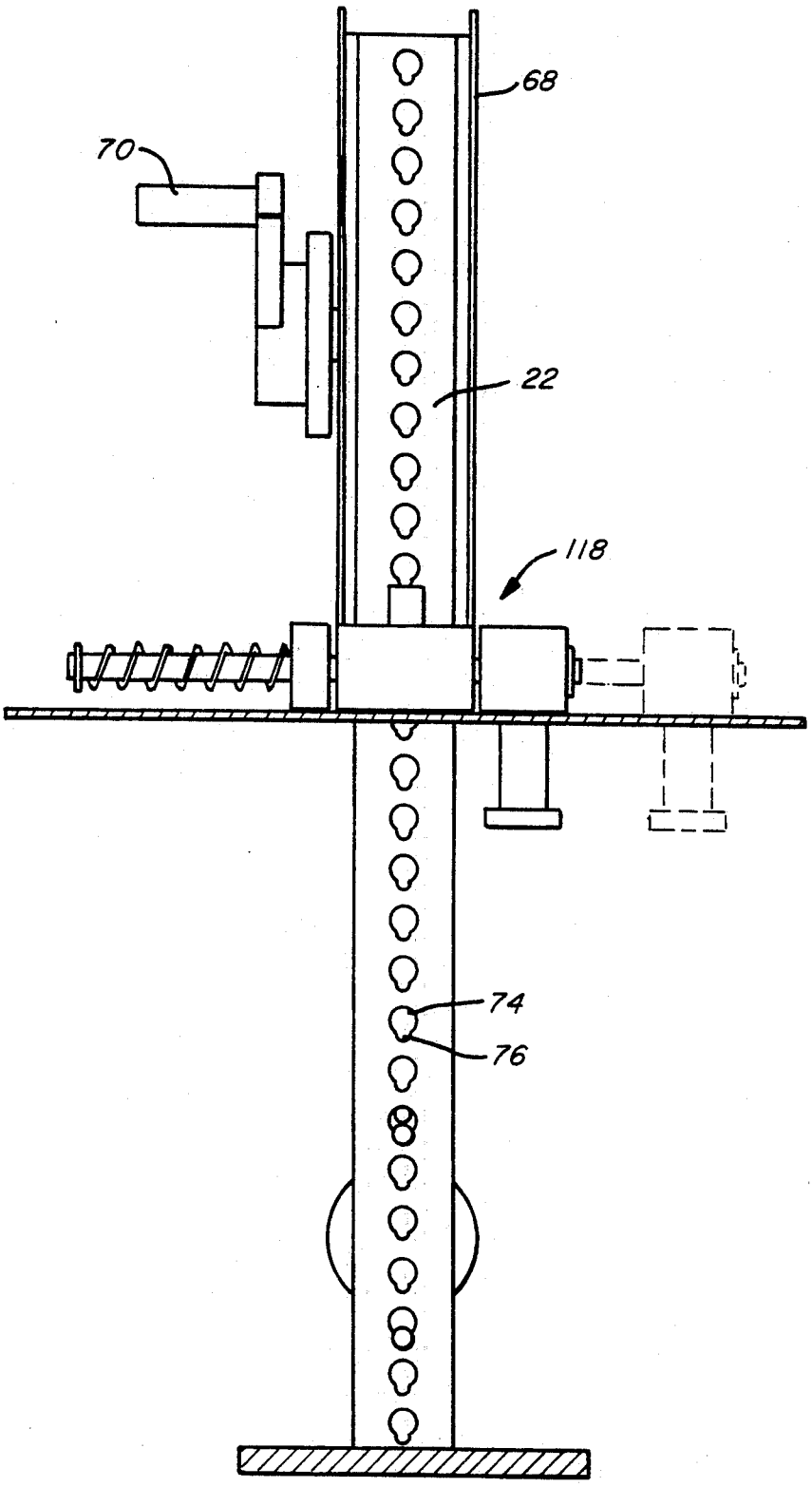
FIG. 5 shows the belt in elevation, as well as a pinch roller assembly for temporary support thereof.

Wound around drum 68 is belt 22. As shown in FIGS. 8 and 5, belt 22 has openings on repeating center lines. The openings consist of a large circle 74 (see FIG. 5) intersected by a smaller circle 76 to form one cohesive cutout which repeats itself on belt 22. Other opening shapes or methods of attachment may be used without departing from the spirit of the invention.

Figure 7:
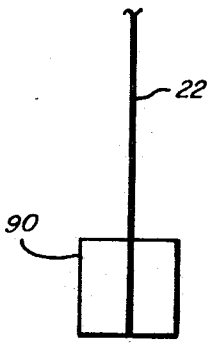
FIG. 7 is an elevational view of the lower end of the belt.
Figure 4:
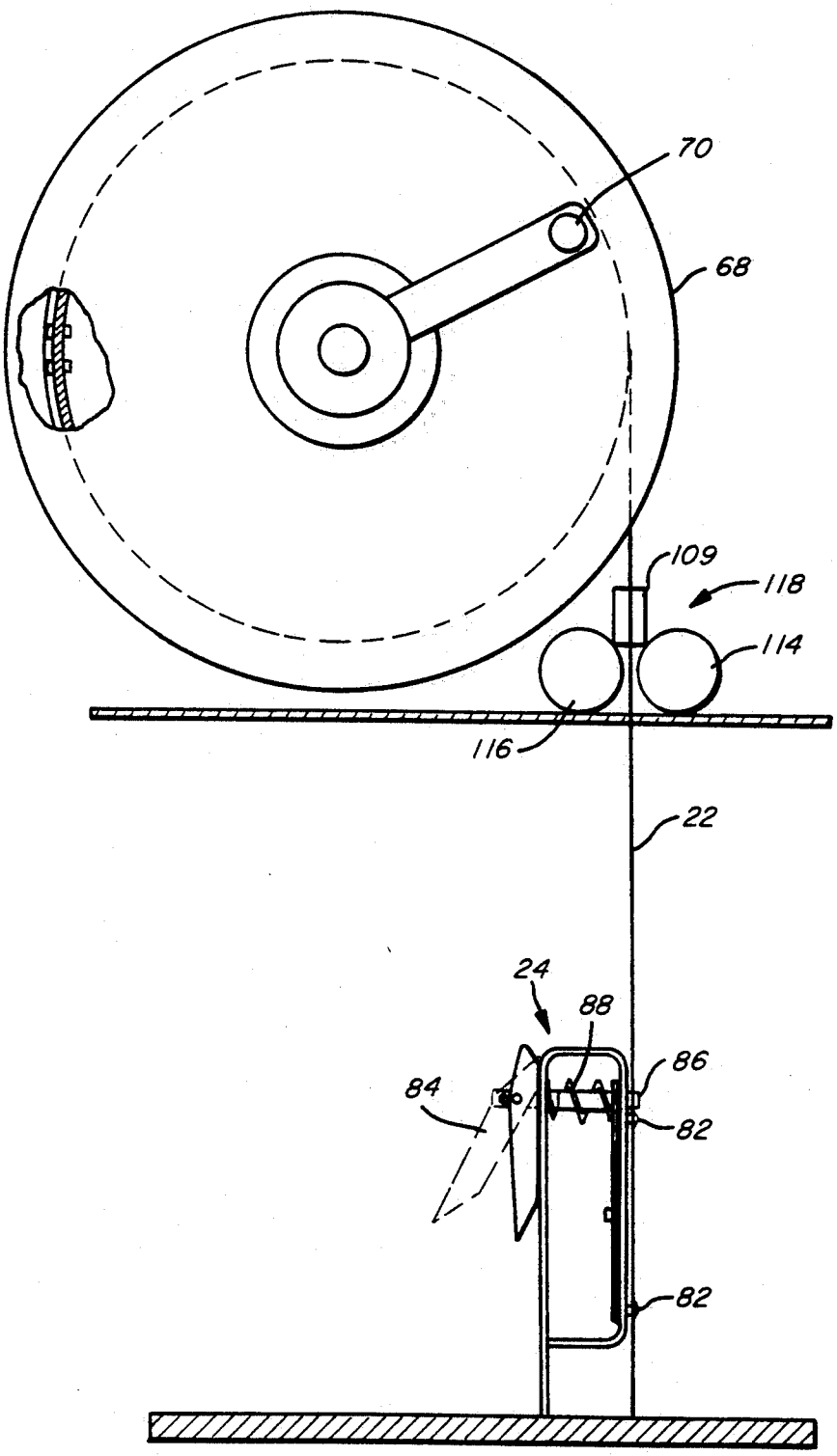
FIG. 4 is a sectional elevational view showing the drum and the sources and how they are attached to the belt.

It is desirable to get the source holders 24 from the position shown in FIG. 1 to the position shown in FIG. 4 so that they can be lowered into well 18 for use. The first step in accomplishing this is to pull back source holder locking door 54 which exposes slot 62 to opening 64. Thereafter, the sources 24 can be taken and raised up by a frame 25 (see FIG. 6) until segment 78 (see FIG. 6) of frame 25 is brought to the elevation of slot 62 for sliding therethrough into well 64. At this time, while segment 78 is translated through slot 62 toward opening 64, radioactive source 80, which is preferably held in a stainless tube with a tungsten shield, is still within the housing 10 which is fully shielded. As shown in FIG. 1, the source holders of the preferred embodiment must be rotated 90 degrees to get them to go onto belt 22. The attachment of source holder 24 to belt 22 is illustrated in FIG. 4. Each source holder has a pair of headed studs 82 which are positioned so that when placed in alignment with the openings 74 and 76 of belt 22, each headed stud 82 will project initially through the larger circular opening 74. Thereafter, the source holder is slid down so that each headed stud 82 engages the smaller circular opening 76 for support. While the insertion of the headed stud through large opening 74 and smaller opening 76 is ongoing, handle 84 is pulled back into the position shown in dashed lines in FIG. 4. Pulling back the handle 84 retracts pin 86. After the headed studs 82 have landed in the smaller opening 76, handle 84 is released. Spring 88 pushes pin 86 outwardly as shown in FIG. 4 until it occupies the larger circular opening 74 and abuts the headed stud 82. At that point in time, the source holder 24 is securely fastened to belt 22 and handle 84 is in the position shown in solid lines in FIG. 4. More of belt 22 can be played out by turning drum crank 70. As a result of turning drum crank 70, a weight 90 (see FIG. 7), which is attached to the end of belt 22, helps to pull the belt downwardly into the well 18 (see FIG. 9). Rotation of crank 70 allows the weight 90 to go through opening 64. Thereafter, at selective hole locations on belt 22, the appropriate source holder 24 can be moved through slot 62 into position for mounting according to the procedure previously described and shown in FIG. 4. A belt support bracket 92 backs up belt 22 so that when the headed studs 82 are pushed through large opening 74 to be secured into smaller opening 76 adjacent thereto, the belt is supported to facilitate the attachment process.

The apparatus A of the present invention also has a feature to prevent dropping the source holders 24 into space 20 of well 18 (see FIG. 9). Referring to FIGS. 1 and 2, there is a safety door 94 which is shown in the closed position in FIG. 1. With door 94 in the position shown in FIG. 1, the upper end of the source holders 24 cannot fit down opening 64. When it is desired to lower a source holder 24 beneath opening 64, lever 96 is actuated which on the one hand releases pawl 98. Pawl 98 is normally engaged to ratchet wheel 100 so as to prevent downward progress of tape 22 into well 18 unless the pawl 98 is released from contact from ratchet wheel 100 due to the operation of lever 96. As seen in FIGS. 1 and 2, pulling upwardly or in a clockwise direction on lever 96 pulls up link 102 which is in turn pivotally mounted to rod 104 which is connected to door 94. Door 94 is biased to a closed position by spring 106. Accordingly, the procedure is to strongly secure a source holder 24 to belt 22 by the method previously described and illustrated in FIG. 4. Thereafter, lever 96 is actuated and while it is held up, crank 70 is rotated to lower the belt further into well 18 to facilitate placement of additional sources.

Having reached the point of accurately placing each source on the belt with the proper spacing, it is desirable to suspend belt 22 in space 20 of well 18 (see FIG. 8). First, an upper stop block 109 is attached to belt 22 to support it from rollers 114 and 116. The housing 10 is lifted and a lower stop block 108 is attached to belt 22. Lower stop block 108 has a pair of pins 110 and 112 which are spaced the same distance as a pair of adjacent circular openings 74. Using pins 110 and 112, the lower stop block 108 is attached to belt 22 and ultimately comes to rest inside the opening 20 of well 18. If the suspension point of the sources 24 needs to be changed by moving the entire belt 22, this can be readily accomplished as shown in FIG. 8. Belt 22 is raised until lower stop block 108 is readily accessible. At that time, if the block needs to be lowered, thereby raising belt 22, pin 110 is pulled out and the block is rotated about pin 112 until pin 110 engages the next lower opening as illustrated in FIG. 8. The rotation can be reversed to effectively raise the lower stop block 106 with respect to belt 22 by leaving pin 110 secure while undoing pin 112 and rotating the lower stop block 108 upwardly until pin 112 can be reinserted into the next highest circular opening 74.

Figure 10:
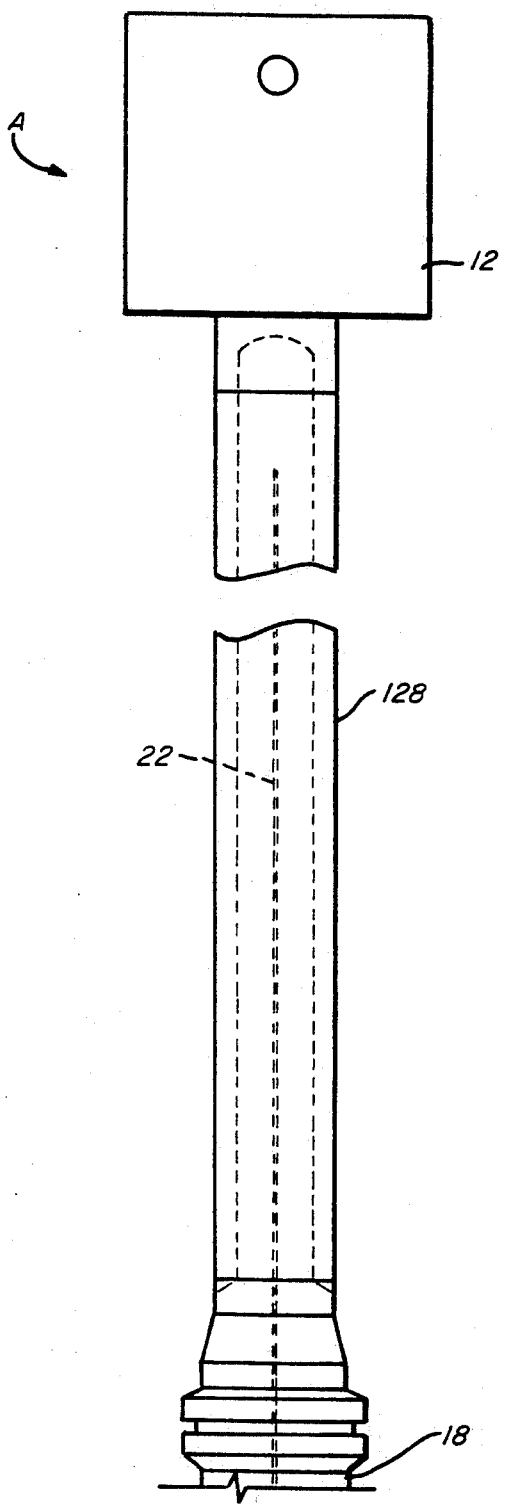
FIG. 10 is an elevational view of a mounting housing which can be put on a well after the source housing shown in FIG. 1 is removed and the sources are in place.
Figure 1:
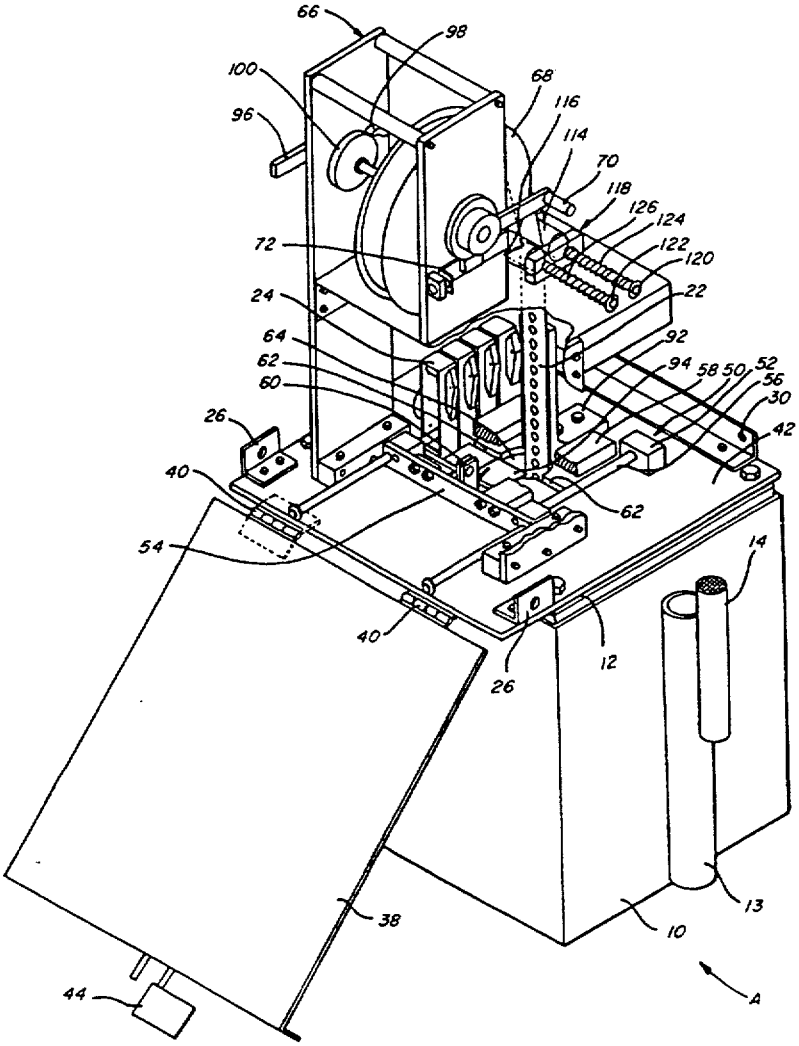
Figure 6:
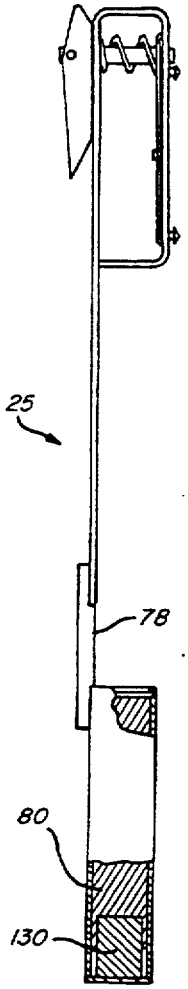

While the lower stop block 108 is being secured, belt 22 is independently supported separately from upper stop block 109. This is best shown in FIGS. 1, 4, and 5. As seen in FIG. 1, belt 22 travels between a pair of rollers 114 and 116. Rollers 114 and 116 are supported in a guide roller assembly 118 and are capable of translating in the two positions in FIG. 5. The rollers 114 and 116 are mounted to pins 120 and 122, respectively. Springs 124 and 126 bias the rollers 114 and 116 into the position shown in FIG. 1 where upper stop block 109 rests against rollers 114 and 116 to effectively support belt 22 on the guide roller assembly 118. Thereafter, the remaining portions of belt 22 are played out of drum 68, and belt 22 is detached from the drum 68 by moving rollers 114 and 116 to the side while leaving upper stop block 109 on belt 22. Belt 22 is marked so that placement of lower stop block 108 is guided by the location of upper stop block 109 on belt 22. Housing 10 can be removed from well 18 with upper stop block 109 still attached. This also facilitates accurate sources 24 placement on reinsertion of the sources 24 after maintenance procedures. While this procedure is going on, it is preferred to have lower stop block 108 firmly in position supporting belt 22 within space 20 of well 18 as shown in FIG. 9. Having ensured that belt 22 is firmly supported by stop lock 108, the housing 10 can be removed after belt 22 is detached from drum 68. At this point, the rollers 114 and 116 are moved to the dashed position shown in FIG. 5 where they no longer support belt 22. Accordingly, the guide roller assembly 118 is a temporary support for belt 122 used during the removal process for housing 10. Having removed the housing 10 at flange 48, the remaining segment of belt 22 is straightened as shown in FIG. 10 and a housing 128 is placed over the extended section of belt 22 above lower stop block 108. For clarity, lower stop block 108 is not illustrated in FIG. 10.

Those skilled in the art can appreciate that various means of attachment to belt 22 can be employed. It is the separate mounting of the sources 24 and the means of attachment to belt 22 as the belt is being lowered into well 18 that allows the use of a compact drum 68 and as a result a more compact housing 10. While a safety door 94 is illustrated, various other means of preventing the sources 24 from falling through opening 64 can be employed without departing from the spirit of the invention. Various different materials can be used for the components; however, the preferred embodiment for the belt is inconel and the preferred materials for the source holder are stainless steel in combination with a shield about source 130 (see FIG. 6) made of tungsten.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for insertion and removal of at least one radioactive source into a well or other enclosure comprising:

a housing, said housing shielded at least in part;

at least one source having a frame supported by said housing during transport and having its radioactive component shielded inside said housing;

delivery means on said housing for selectively raising and lowering said source after said source is selectively attached to said delivery means; and said housing formed to allow a shielded path for manipulation of said source by said frame from its position supported by said housing during transport to a second position attached to said delivery means.

2. The apparatus of claim 1, wherein said delivery means comprises:

a belt, said delivery means moving said belt up and down to change the position of said source selectively mounted on said belt.

3. The apparatus of claim 2, wherein said belt is configured to accept selective placement of at least one of said source at a plurality of locations thereon.

4. The apparatus of claim 3, wherein said belt is perforated with a plurality of openings.

5. The apparatus of claim 4, wherein said openings further comprise:

a first segment;

a second segment;

said frame of said source further comprises:

a headed pin insertable freely through said first segment opening and selectively trapped by said second segment opening.

6. The apparatus of claim 5, wherein said frame of said source further comprises:

a locking member insertable selectively into said large segment opening after said headed pin has been put in said position where it is trapped by said smaller segment opening, thereby selectively preventing disengagement.

7. The apparatus of claim 1, further comprising:

blocking means on said housing to selectively prevent said source from dropping into the well while it is selectively in a closed position.

8. The apparatus of claim 7, wherein:

said blocking means, in said closed position, does not obstruct said path in said housing for transfer of said source between said position during transport and said second position attached to said delivery means.

9. The apparatus of claim 8, further comprising:

interlock means operable on said delivery means and said blocking means, said interlock means preventing operation of said delivery means which would otherwise result in lowering of said source, said interlock means, when defeated, allowing said delivery means to lower said source while moving said blocking means into an open position away from the downward path of said frame of said source to allow it to be lowered into the well.

10. The apparatus of claim 2, wherein:

said belt is formed to accommodate more than one said source with the spacing between sources variable per the needs of the particular application.

11. The apparatus of claim 2, further comprising:

temporary support means selectively mountable to said belt to support said belt from the well in lieu of from said delivery means to allow removal of said housing from the well; and said temporary support means so mounted to said belt so as to allow a change of its position while continuing to support said belt, thereby allowing selective change of position of said source within the well without use of said delivery means.

12. The apparatus of claim 11, wherein said belt has a plurality of perforations;

said temporary support means comprises:

a body;

a plurality of fasteners selectively aligned with said perforations each said fastener selectively disengageable from said belt allowing said body to pivot on another fastener to selectively raise or lower said belt while said body continues to support said belt in the well.

13. The apparatus of claim 1, further comprising:

securing means on said housing to selectively hold said source in its transport position, blocking said path, during transport of the housing.

14. The apparatus of claim 4, further comprising:

blocking means on said housing to selectively prevent said source from dropping into the well until it is selectively activated from a closed to an open position.

15. The apparatus of claim 14, further comprising:

interlock means operable on said delivery means and said blocking means, said interlock means preventing operation of said delivery means which would otherwise result in lowering of said source, said interlock means, when defeated, allowing said delivery means to lower said source while moving said blocking means into an open position away from the downward path of said source to allow it to be lowered into the well.

16. The apparatus of claim 15, wherein:

said belt is formed to accommodate more than one said source with the spacing between sources variable per the needs of the particular application.

17. The apparatus of claim 16, further comprising:

temporary support means selectively mountable to said belt to support said belt from the well in lieu of from said delivery means to allow removal of said housing from the well; and said temporary support means so mounted to said belt so as to allow a change of its position while continuing to support said belt, thereby allowing selective change of position of said source within the well without use of said delivery means.

18. An apparatus for insertion of at least one radioactive source into a well, comprising:

a housing, said housing shielded at least in part;

at least one source supported for transport by said housing, said source having a radioactive component and a frame extending therefrom;

a belt, said belt adapted to accept one and more than one of said source for mounting at selectively different points thereon;

means connected to said housing for takeup and payout of said belt, and to house said belt without said source connected thereto for transport of said source.

19. The apparatus of claim 18, wherein:

said housing is formed to include a shielded path, allowing shielded manipulation of said source from said frame which extends at least in part outside said housing to move said source from its transport position to attachment to said belt.

20. The apparatus of claim 19, further comprising:

means for selectively preventing dropping said frame of said source completely into said housing until it is secured to said belt.

21. The apparatus of claim 20, further comprising:

interlock means on said housing acting on said takeup and payout means and said prevention means to prevent payout and to enable said prevention means, in a first position of said interlock means; and to disable said prevention means and allow payout in a second position of said interlock means.

22. The apparatus of claim 21, further comprising:

temporary support means adapted to engage said belt to support it independently of said takeup and payout means to facilitate disconnection of said belt from said takeup and payout means.

23. The apparatus of claim 22, wherein:

said belt is formed having a plurality of perforations;

said temporary support means further comprises:

a first block engageable with said perforations and capable of shifting positions with respect to said belt while connected to said belt through at least one opening, said first block when attached to said belt supporting said belt to the well to facilitate removal of said housing from the well.

24. The apparatus of claim 23, wherein said temporary support means further comprises:

a second block mountable to said belt;

a pair of guide rollers selectively positioned to guide said belt and to hold said belt when said second block engages said guide rollers, whereupon said housing can be lifted to allow attachment of said first block prior to complete removal of said housing from the well, said rollers retractable into a second position where they do not engage said second block to allow removal of said belt from said takeup and payout means.

25. The apparatus of claim 24, further comprising:

a weight mounted to said belt to assist said takeup and payout means in paying out said belt until at least one source is attached.

* * * * *

UNITED STATES PATENT AND TRADEMARK OFFICE

CERTIFICATE OF CORRECTION

PATENT NO. : 5,272,349
DATED : 12/21/93
INVENTOR(S) : Hugh L. Perry, III

It is certified that error appears in the above-identified that said Letters Patent is hereby corrected as shown below:

The title page showing the illustrative Figure should be deleted to be substituted with the attached title page.

Figure 6:
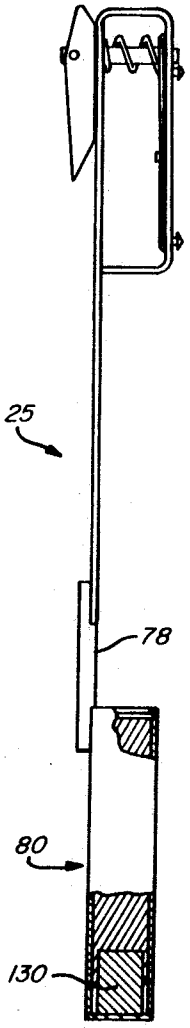
FIG. 6 is a sectional elevational view of the source holder.

In the drawings Figs. 1 and 6 should be deleted to be replaced with Figs. 1 and 6, as shown on the attached page.

United States Patent [19]

Perry, III

[11] Patent Number: 5,272,349

[45] Date of Patent: Dec. 21, 1993

[54] SOURCE HANDLING APPARATUS

[76] Inventor: Hugh L. Perry, III, 7809B Hardy Dr., Austin, Tex. 78757

[21] Appl. No.: 897,234

[22] Filed: Jun. 11, 1992

[51] Int. Cl.[5] ..... G21F 5/02

[52] U.S. Cl. ..... 250/497.1; 250/357.1; 378/52

[58] Field of Search ..... 250/496.1, 497.1, 357.1; 378/52; 414/146; 600/3, 7

[56] References Cited

U.S. PATENT DOCUMENTS 2,708,721 5/1955 Ziffer ..... 378/52

4,785,178 11/1988 Lynch et al. ..... 250/497.1

*Primary Examiner*—Jack I. Berman

*Attorney, Agent, or Firm*—Rosenblatt & Associates

[57] ABSTRACT

A compact design of a shielded housing for transport and insertion of radioactive sources into wells for use in measuring properties of materials in vessels and the like is disclosed in this invention. The apparatus features a perforated belt which is wound on a drum. The sources are temporarily supported within the shielded housing and can be moved into place and mounted to the belt at the desired locations. Safety features are provided to avoid dropping the sources into the well and to temporarily support the belt so that the transport housing can be removed. The invention also provides for adjustment of the mounting height of the source or sources mounted to the belt.

25 Claims, 7 Drawing Sheets

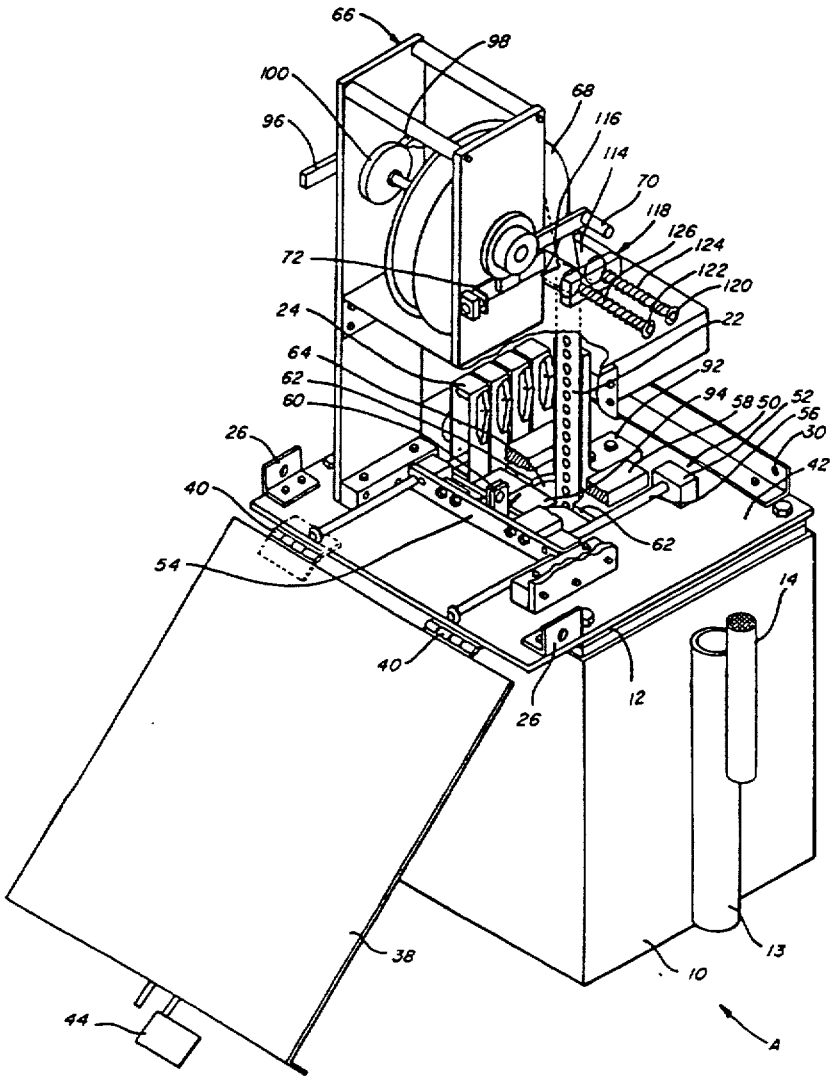

UNITED STATES PATENT AND TRADEMARK OFFICE

CERTIFICATE OF CORRECTION

PATENT NO. : 5,272,349
DATED : 12/21/93
INVENTOR(S) : Hugh L. Perry, III

It is certified that error appears in the above-identified that said Letters Patent is hereby corrected as shown below:

At column 2, line 63, please delete "lock" and insert --block-- therefor.
At column 3, line 28, please delete "lugs" and insert --brackets-- therefor.
At column 3, line 63, please delete "59" and insert --56-- therefor.
At column 4, line 14, please delete "door" and insert --bar-- therefor.
At column 4, line 20, please delete "80" and insert --13--- therefor.
At column 4, line 21, please delete "tunsten shiedl," and insert --tungsten shield 80,-- therefor.
At column 4, line 67, please delete "tape" and insert --belt-- therefor.
At column 5, line 31, please delete "106" and insert --180-- therefor.
At column 5, line 61, please delete "lock" and insert --block-- therefor.
At column 5, line 66, please delete "122" and insert --22-- therefor.
At column 6, line 16, please delete "iconel" and insert --Iconel-- therefor.

Signed and Sealed this

Second Day of August, 1994

*Attest:*

Bruce Lehman

BRUCE LEHMAN

*Attesting Officer*

*Commissioner of Patents and Trademarks*